US008376654B2

(12) United States Patent
Kleiger

(10) Patent No.: US 8,376,654 B2
(45) Date of Patent: Feb. 19, 2013

(54) METHOD AND APPARATUS FOR REPAIRING POTHOLES AND THE LIKE

(75) Inventor: Scott P. Kleiger, Harleysville, PA (US)

(73) Assignee: Patch Management, Inc., Fairless Hills, PA (US)

( * ) Notice: Subject to any disclaimer, the term of this patent is extended or adjusted under 35 U.S.C. 154(b) by 140 days.

(21) Appl. No.: 12/871,466

(22) Filed: Aug. 30, 2010

(65) Prior Publication Data

US 2011/0070025 A1 Mar. 24, 2011

Related U.S. Application Data

(60) Provisional application No. 61/243,684, filed on Sep. 18, 2009.

(51) Int. Cl.
*E01C 23/02* (2006.01)

(52) U.S. Cl. ..... 404/107; 404/108; 404/111; 134/10

(58) Field of Classification Search ..... 134/22.12; 404/101, 107, 108, 109, 111
See application file for complete search history.

(56) References Cited

U.S. PATENT DOCUMENTS 2,583,165 A 1/1952 Campbell
3,771,893 A * 11/1973 Miller ..... 404/101
4,073,152 A * 2/1978 Kishitani et al. ..... 405/268
4,820,078 A * 4/1989 Brocious ..... 404/92
5,226,454 A 7/1993 Cabalfin
5,232,306 A * 8/1993 Sterner ..... 404/107
5,263,790 A * 11/1993 Bickley et al. ..... 404/107
5,419,654 A * 5/1995 Kleiger ..... 404/101
5,765,963 A * 6/1998 Roberts ..... 404/92
6,245,216 B1 6/2001 Hill et al.
7,481,601 B2 * 1/2009 Gilchrist ..... 404/109
7,544,253 B2 * 6/2009 Kleiger et al. ..... 134/10
2008/0031688 A1 * 2/2008 Gilchrist ..... 404/108
2008/0035177 A1 2/2008 Kleiger et al.

* cited by examiner

*Primary Examiner* — Thomas B Will
*Assistant Examiner* — Matthew D Troutman
(74) *Attorney, Agent, or Firm* — Volpe and Koenig, P.C.

(57) ABSTRACT

A vehicle mounted patching system for patching potholes and the like and incorporating method and apparatus for removing and flushing asphalt emulsion from the feed lines of the patcher which completely recycles the cleaning agent used to flush the feed lines, as well as eliminating any external discharge of potentially toxic materials. A cleaning agent is used to flush the feed lines. The emulsion is collected in a recovery tank and combined with fresh emulsion delivered from a storage tank when the collected emulsion reaches a given concentration. Electrical controls for operating both motors from a single power source employ arrays of cam-operated switches and a diode array polarized to prevent feedback of power from the power source to assure precision positioning of the multi-position valves to perform a given operation.

9 Claims, 10 Drawing Sheets

FIG. 4
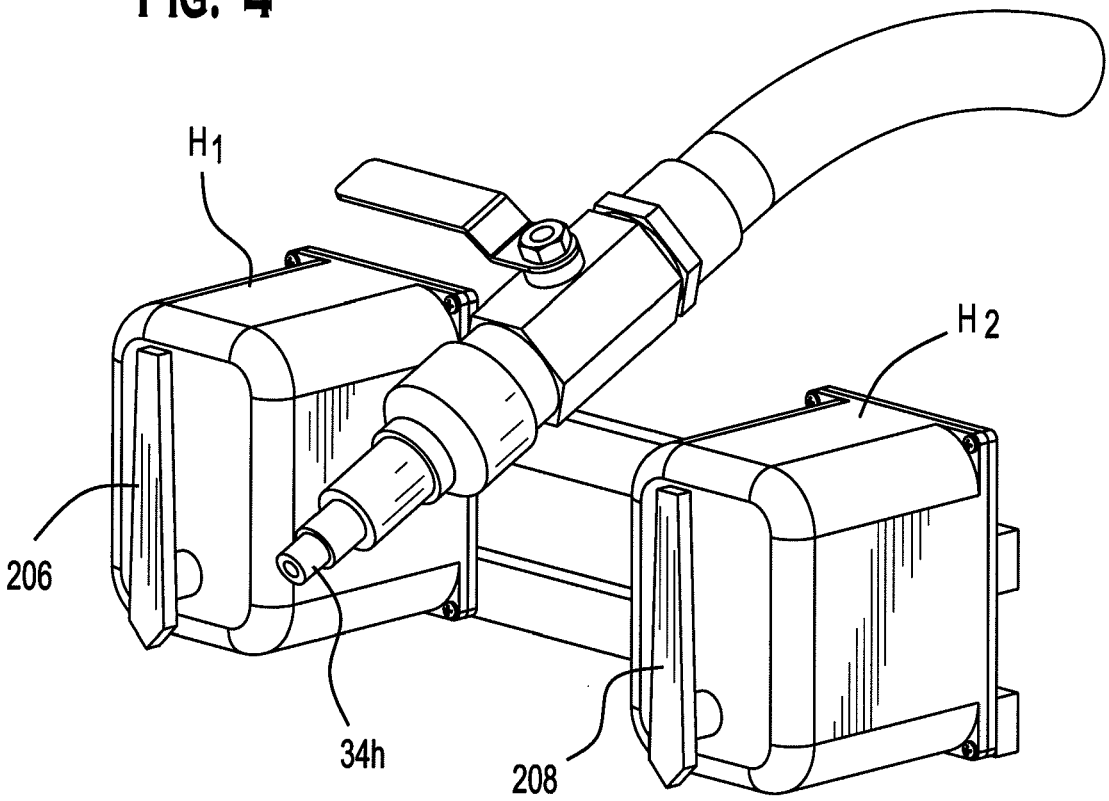
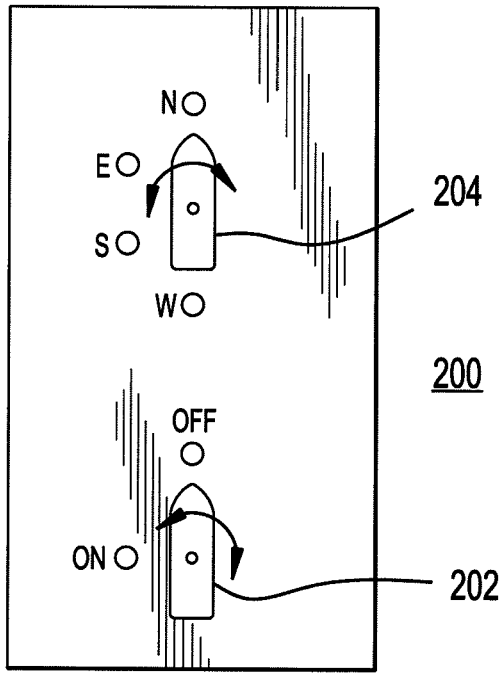
FIG. 4A

METHOD AND APPARATUS FOR REPAIRING POTHOLES AND THE LIKE

CROSS REFERENCE TO RELATED APPLICATION

This application claims the benefit of U.S. provisional application No. 61/243,684 and filing date of Sep. 18, 2009, which is incorporated by reference as if fully set forth.

FIELD OF INVENTION

The present invention relates to patching devices, and more particularly, to vehicle mounted patching systems for patching potholes and the like and incorporating method and apparatus for recapturing asphalt emulsion from the feed lines of the patcher for subsequent reuse.

BACKGROUND

Asphalt patching systems are well known in the art. For example, U.S. Pat. Nos. 5,263,790 issued Nov. 23, 1993 and 5,419,654 issued May 30, 1995, teach a patcher comprising a motor driven, wheeled vehicle having a gravel hopper and a storage tank for liquid emulsion, such as asphalt, as well as pressurized conduits for respectively advancing gravel and asphalt to a mixing head. The asphalt emulsion is delivered from the storage tank to the mixing head by feed lines. The mixing head is arranged to extend from a free end of a swingably mounted, telescoping boom, which is moveable in both horizontal and vertical planes as well as being selectively extendable and retractable to expedite desired positioning of the mixing head above a roadway surface to be patched. The pressurized conduits may also be initially employed to blow debris from the pothole or crevice being patched whereupon an emulsion such as asphalt, with or without aggregate, is delivered to the mixing head. The need for rolling or tamping is eliminated by the use of high-pressure air.

The feed lines carrying the asphalt emulsion must be cleaned on a regular basis, typically at least once per day.

Present day techniques for repairing a pothole after it is cleared of debris, includes:

a) clearing debris from the pothole;

b) coating the pothole surface with an emulsion;

c) filling pothole with admixed emulsion and a suitable aggregate; and d) coating top surface of the filled pothole with pulverized stone.

Due to the need to return roadways to use as quickly as possible after a repair operation, it is nevertheless disadvantageous to use a top coat of pulverized stone since tires of passing vehicles often kick up the pulverized stones into other vehicles causing damage to front, rear or side windows doors, fenders and the like. Also the top layer of crushed stone contrasts with the darker, surrounding road surface.

It is therefore desirable to provide method and apparatus for repairing a pothole which enables immediate use of the repaired surface while preventing damage to vehicles passing along the repaired surface. In addition, the apparatus described herein is capable of performing the novel method requiring a minimal amount of operator intervention.

In addition, it is also highly desirable to reclaim the emulsion from the conduits for reuse.

SUMMARY

The present invention is characterized by comprising method and apparatus embodiments for flushing the emulsion feed lines of a patching system and collecting the emulsion for reuse.

Feed lines providing asphalt emulsion to a mixing head, which is utilized to mix aggregate and the asphalt emulsion, are selectively fed emulsion and cleaned under control of a pair of four-position valves arranged adjacent to and preferably on opposite sides of the mixing head. The valve pair is remotely operated from the patcher cabin employing an electronic control characterized by a simplified and yet highly reliable design. When moved to a "patching" position, normal patching operations are performed i.e., emulsion is fed to the mixing head to perform patching.

By moving both valves to a "clearing" or "blowback" position, and opening a similar valve at the tank holding the asphalt emulsion, the ports of the pair of four-position valves enable high pressure air, preferably derived from the air brake system of the patcher, to enter the asphalt emulsion feed lines that are connected between the tank holding the asphalt emulsion and the mixing head. The pressure in the asphalt emulsion tank is lower than the entering pressure from the air brake system, whereby the asphalt emulsion in the feed lines is forced back to the asphalt storage tank, leaving only a small residue in the asphalt emulsion feed lines. If desired, the patching and clearing operations may be reversed in their order of performance.

The next step performed in the procedure is to close the conduit between the emulsion storage tank and the feed lines and place the pair of four-position valves adjacent to the mixing head in a third ("flushing") position which opens the ports to a conduit connected to a flush tank containing a cleaning agent maintained under pressure. The valve at the asphalt emulsion tank is turned to the flush position, coupling the asphalt emulsion feed lines to the pressurized flush tank, which causes the cleaning agent to move through and flush the feed lines and valves, which feed lines include at least one section of clear hose coupled to a given port of one of the pair of control valves to facilitate observation of the progress of the flushing operation. The cleaning agent flushes the feed lines as well as the pair of valves adjacent to the mixing head and the valve coupling the flush tank to the pair of valves. The cleaning agent then flows out through given ports of the pair of valves and directly into a recovery tank and is maintained in the recovery tank which is preferably positioned above the flushing tank. The cleaning agent is returned from the recovery tank to the flush tank by closing the line between the flush tank and the source of air pressure, venting the flush tank to the atmosphere and opening a valve in the line between the flush tank and the recovery tank when the flush tank is depressurized, enabling the cleaning agent to return by the force of gravity to the flush tank. The flush tank is then sealed from the atmosphere and the air supply valve is then opened to pressurize the flush tank in readiness for a subsequent flushing operation.

Pressurized air is drained out of the flush tank by opening an air bleed valve. When the pressure gauge of the flush tank reads "O" psi, the valve in the line coupling the recovery tank to the flush tank is opened to enable the cleaning agent to flow by gravity back into the flush tank. This valve preferably remains open for approximately 2 to 3 minutes and is then closed. The flush valve adjacent to the flush tank is closed and the valve between the flush tank and the air pressure source is opened to re-pressurize the flush tank in readiness to perform a subsequent flushing operation, at which time the cleaning process is completed without removal of either emulsion or cleaning agent from the patching system and thereby providing for recycling of both the emulsion and the cleaning agent.

An extract of pine oil is employed as the preferable cleaning agent. The emulsion removed from the interior surfaces of the feed lines by the pressurized cleaning agent passes into the recovery tank and mixes with the cleaning agent. Over a period of time, typically three (3) to five (5) weeks, the amount of emulsion accumulated reaches a concentration which is equivalent to the concentration of emulsion in the emulsion storage tank, enabling the accumulated emulsion to be dispensed through the feed lines and mixing head into a pothole being repaired. This technique makes more efficient use of the emulsion as well as the cleaning agent. The quality and cohesiveness of the emulsion/cleaning agent mixture is as good as the original emulsion dispensed into a pothole being repaired, as well as admixing equally well with the emulsion from the storage tank.

The pair of 4-position valves are operated by controls provided in the cab of the patcher. Precision movement of the pair of valves is assured through the use of motor drives under the control of cam-operated control switches, coupled to a single control signal through a diode circuit which prevents feedback of the control signal array when the desired valve positions are not properly aligned.

In one preferred embodiment, the cleaning agent is pine oil extract. During a flushing operation, the pressurized pine oil extract removes the emulsion in the feed lines, the emulsion collected by the cleaning agent being delivered to the recovery tank together with the cleaning agent. Assuming that a fresh effusion of the cleaning agent is introduced into the flush tank, either by way of the recovery tank or directly to the flush tank, and assuming regular, daily usage of the patcher, the amount of emulsion collected in the cleaning agent builds up to a level sufficient to be admixed together with emulsion in the heated emulsion storage tank so as to be sufficiently recaptured and used together with emulsion delivered from the heated storage tank to the dispensing head for performing a patching operation, typically within three to four weeks. In order to assure that the emulsion accumulated in the cleaning agent has reached sufficient concentration level, a visual observation may be made by observing the flow of cleaning agent admixed with emulsion by observing a transparent, see-through section of conduit coupled to the feed line of at least one of the pair of multi-position valves. Alternatively, an instrument may be connected in the feed line to measure the amount of emulsion collected in the cleaning agent, such as a viscometer or a pressure differential indicator. Alternatively, the see-through section and the instrument for measuring the emulsion may both be provided as part of the patcher apparatus.

The pair of multi-position valves are preferably operated from the patcher cabin through an electronic control utilizing a single switch of novel, simplified design in which power is simultaneously delivered in parallel to electric motors for each multi-position valve to accurately drive each valve to the proper position.

A single power source is selectively coupled to both motors through the single switch which is a multi-position switch for selectively connecting power simultaneously to both motors. The lines selectively coupling power to the motors driving the multi-position switches are each provided with a cam-operated switch designed to be normally closed until their switch arms are aligned with a "flat" provided on the respective cams to open the electrical switches when the motors drive the valves to the appropriate position. In order to compensate for any potential differences in the motors during their manufacture, diode arrays are provided for each of the drive motors to prevent the power source from being fed back and coupled through one of the non-selected switch lines to the opposite motor.

A gear box provided for each control valve couples the drive from its associated motor to the control valve through an output shaft which simultaneously drives its associated multi-position control valve as well as rotating the cams, each of which opens its associated switch when its control valve reaches the desired control valve position.

BRIEF DESCRIPTION OF THE DRAWINGS AND PREFERRED EMBODIMENTS THEREOF

The embodiments of the present invention will be understood from a consideration of the detailed description and drawings, wherein like elements are designated by like numerals, and wherein:

FIG. 4 shows a simplified perspective view of the drive motors and associated control circuitry for driving the pair of multi-position valves.

FIG. 4A is a view showing the control switches employed for operating the pair of control valves from the patcher cabin.

DETAILED DESCRIPTION OF THE PREFERRED EMBODIMENTS

Figure 1A:
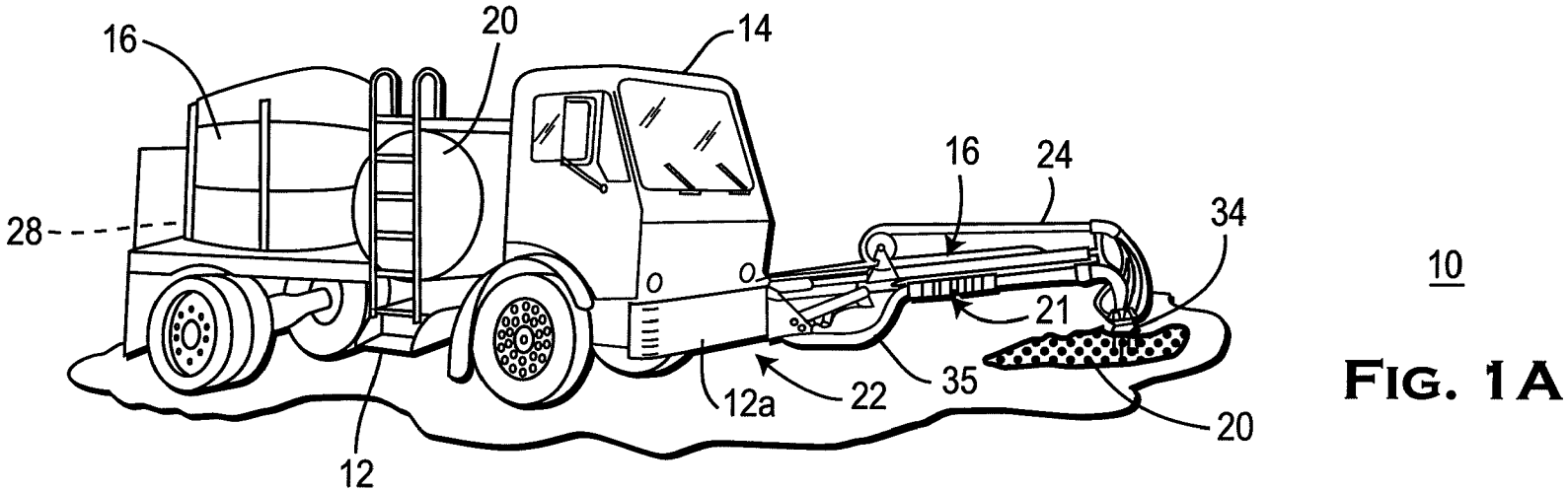
FIGS. 1A, 1B and 1C are perspective views of a patching vehicle embodiment utilizing the novel cleaning technique of the present invention.
Figure 1B:
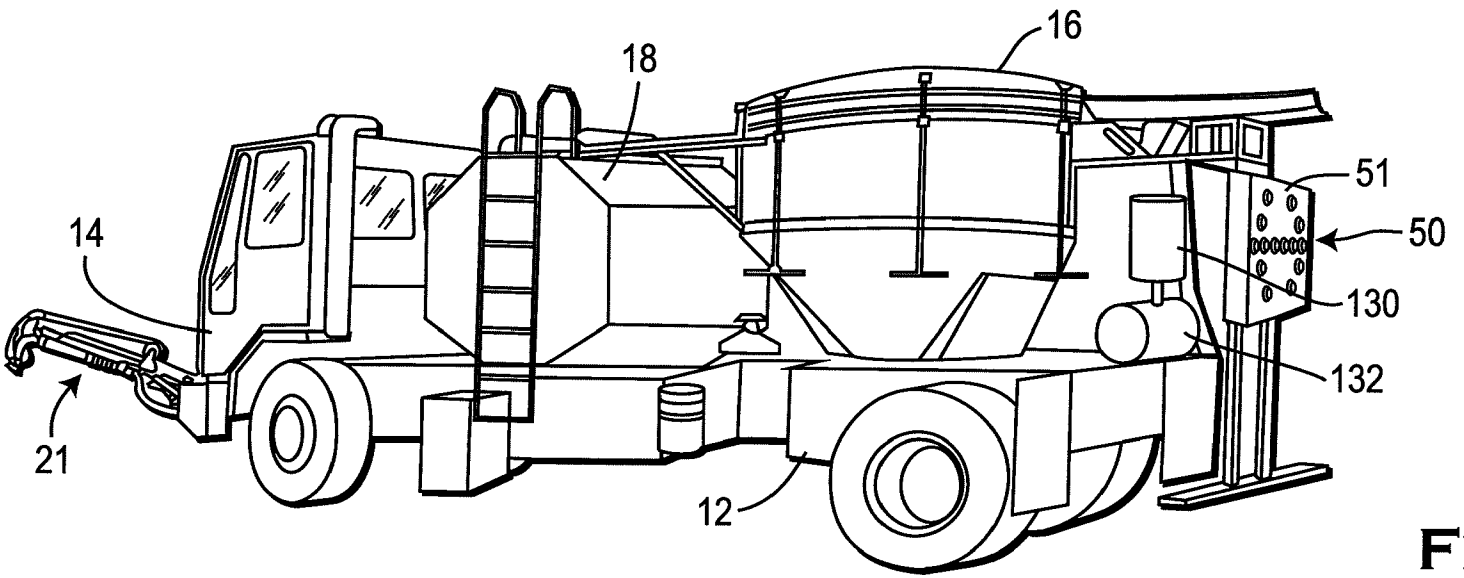
Figure 1C:
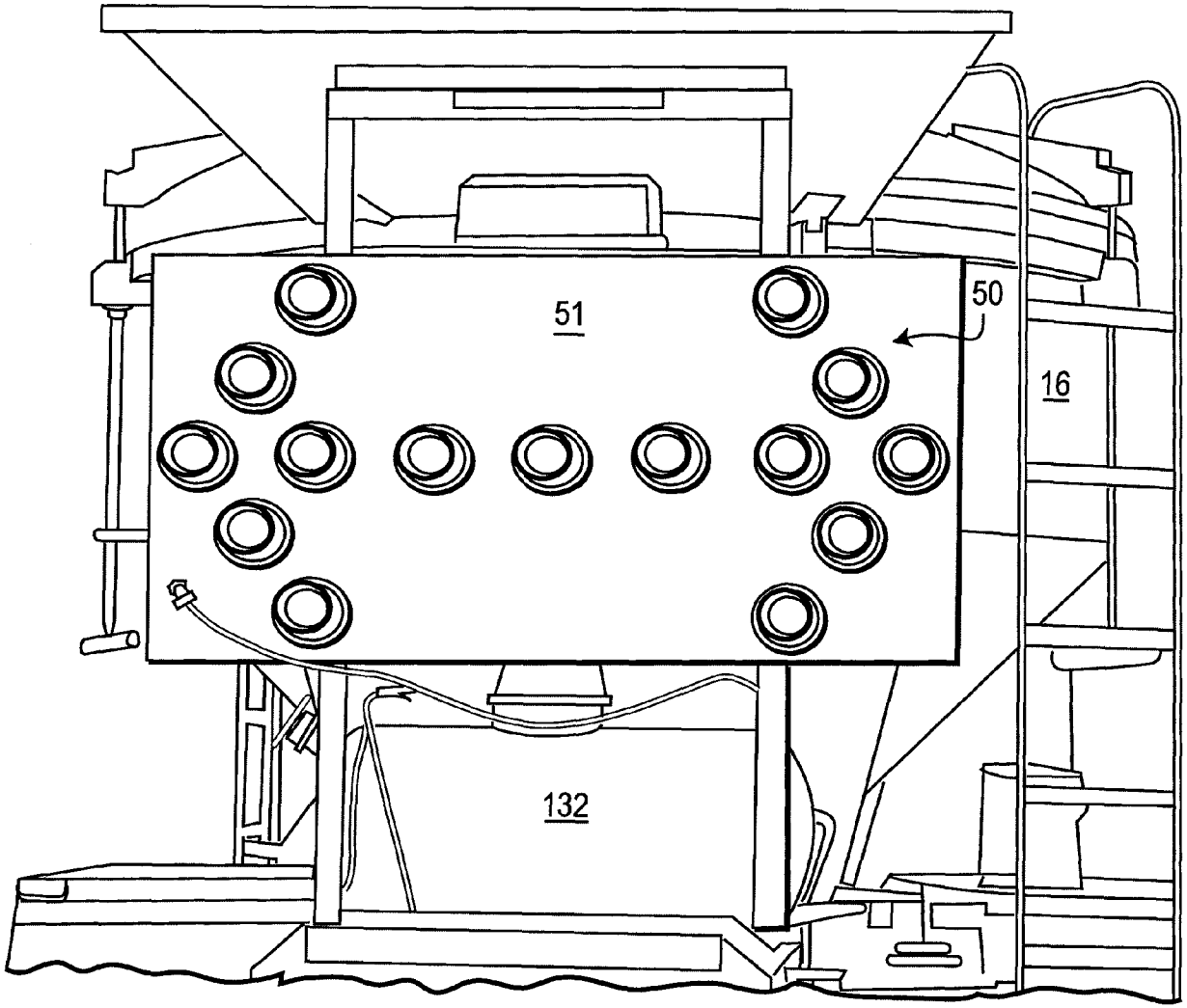

FIGS. 1A-1C are perspective views showing a vehicle (i.e., a "patcher") 10 for patching roadways and the like, typically through the use of an asphalt-gravel mixture and comprised of a wheeled, self-propelled vehicle including a chassis 12 and a cab, 14 containing the vehicle engine (not shown), which is any suitable engine employing an engine cooling system using liquid coolant (such as water or a water/anti-freeze mixture.)

Chassis 12 supports a gravel hopper 16 and an enclosure 18 of substantially hexagonal shape which contains an asphalt emulsion supply tank 20. The asphalt is normally heated to maintain a temperature of the order of 135 to 160 Degrees F.

Figure 2A:
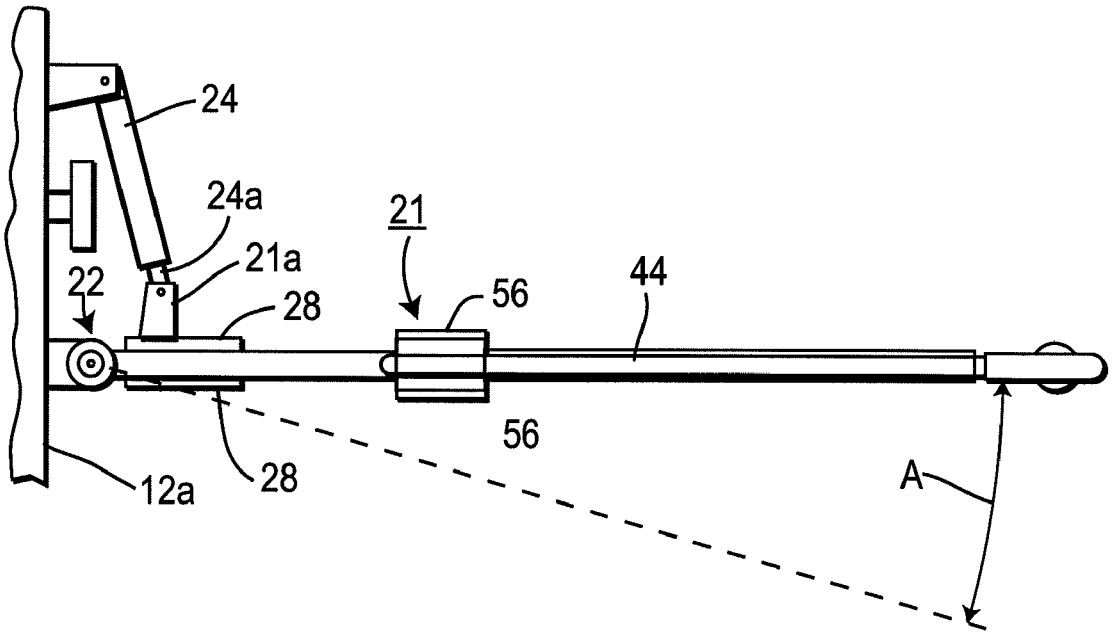
FIGS. 2A and 2B show the mixing head and boom of FIGS. 1A and 1B in greater detail.

A front boom assembly 21 is pivotally mounted to the front end of the cab 14 to enable the boom assembly to swing in a horizontal plane by means of pneumatic cylinder 24, shown in FIG. 2A. Boom assembly 21 is further swingable in a vertical plane under control of cylinder 26, detailed views of the boom assembly 21 and activating cylinders 24 and 26 being respectively shown in FIGS. 2A and 2B.

A flexible hose 35 communicates between gravel hopper 16 and a mixing head 34 arranged at the free end of boom assembly 21. Flexible hose 35 couples gravel hopper 16 to mixing head 34 through a telescoping delivery assembly 36.

The details of the movement of the boom assembly and its various components are set forth in U.S. Pat. No. 5,419,654 which is incorporated herein by reference and further details of the boom assembly and its operation are omitted herein for purposes of simplicity.

It is sufficient to understand, however, that a heated asphalt emulsion and aggregate are respectively fed to the mixing head under suitable air pressure as will be described in detail below.

The hollow, insulated non-collapsible hose 44 typically contains five (5) different fluid carrying lines as well as electrical wires as will be described below in greater detail. Non-collapsible hose 44 is maintained substantially taut regardless of the expansion or retraction of the telescoping delivery tube assembly 36, under control of piston cylinder 16, as is described in detail in the aforementioned issued U.S. Pat. No. 5,419,654.

FIG. 1C shows a rear view of patcher 12 which is provided with an array 50 of red lights mounted upon panel 51 which, when selectively illuminated, appear as left-hand and right-hand arrows to guide vehicles approaching from the rear to either the left or the right (or both the left and right) around the truck as it is performing patching operations.

Figure 3:
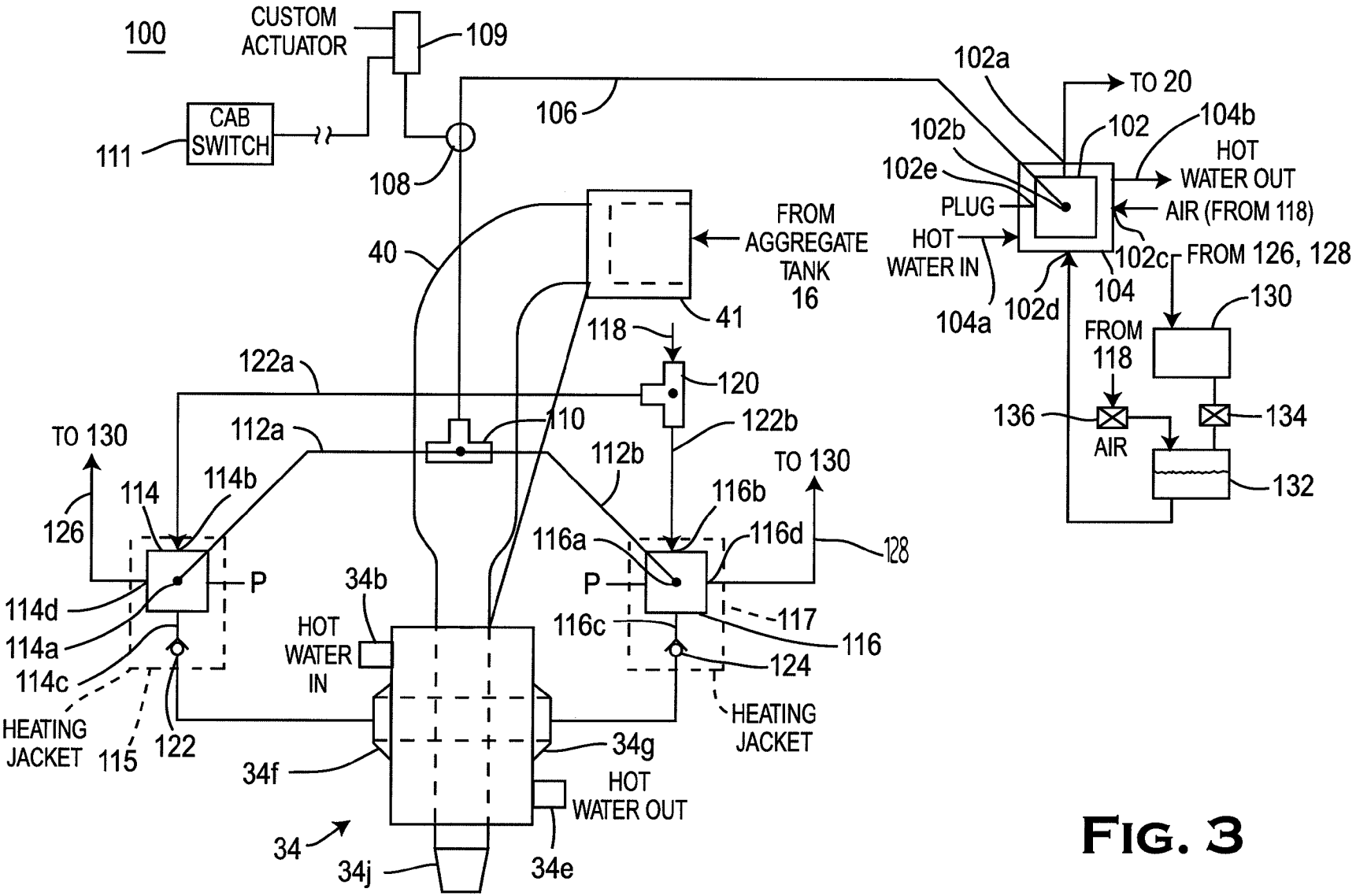
FIG. 3 is simplified schematic diagram embodying the principles of the present invention and which is useful in describing the cleaning procedure of the present application.

FIG. 3 shows a simplified schematic diagram which is useful in explaining the normal patching operations, including the manner in which the feed lines carrying asphalt emulsion are emptied of emulsion and flushed by a cleaning agent, both of which materials are fully recycled, thereby totally avoiding the need to drain any of the emulsion residue and cleaning agent employed in the flushing operation. In other words, a fully self-contained system is provided for performing the cleaning and flushing operations and no fluids or residue are emitted to the atmosphere nor do they leave the self-contained system during the performance of the air cleaning and flushing operations.

Figure 2B:
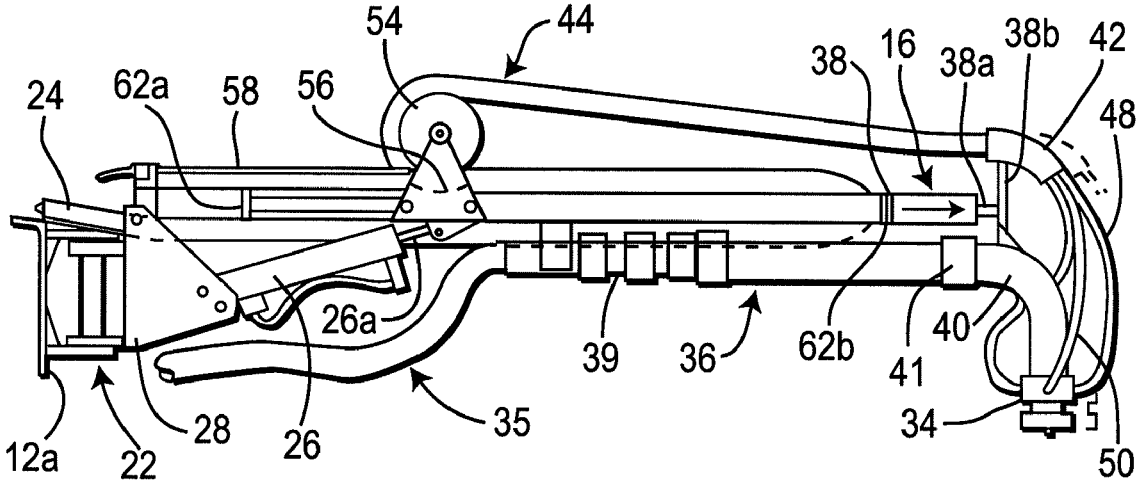

As was described above, the aggregate hopper 16 is coupled to the mixing head 34 by means of the telescoping assembly 36 also shown, for example, in FIG. 2B and provided at its free end with curved tube 40 joined to the telescoping assembly 36 by coupling collar 41. Coupling collar 41 and the curved tube member 40 are shown in FIG. 3 wherein aggregate from hopper 18 passes through coupling 41 and curved tubing 40 and enters into the hollow interior 34*a* of mixing head 34 with the aid of pressurized air.

Figure 3A:
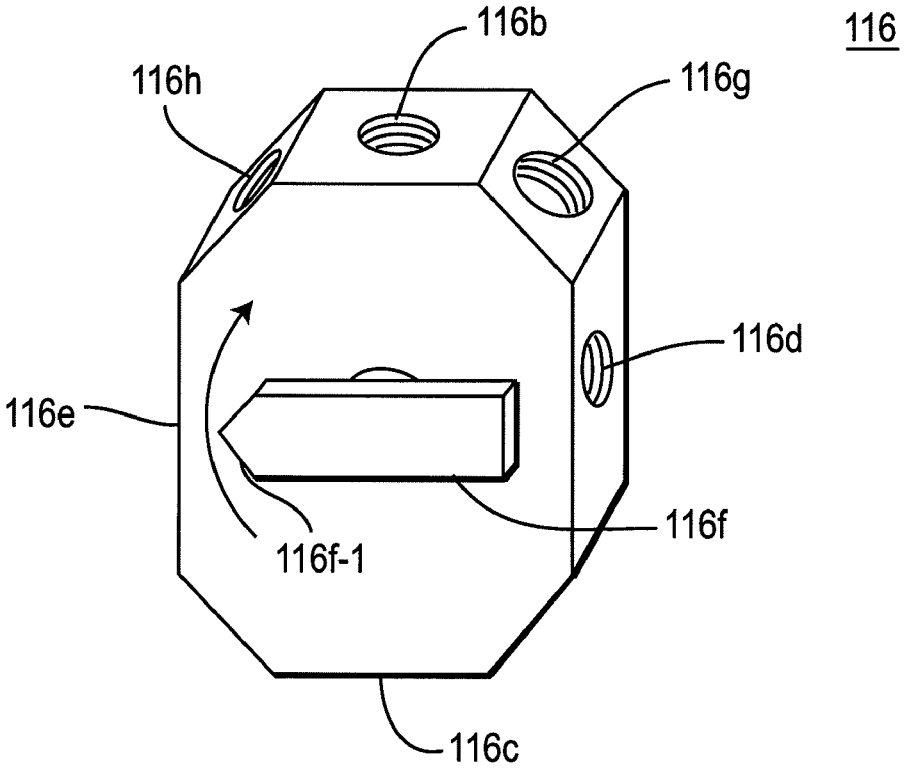
FIG. 3A is a detailed perspective view of one of the multi-position control valves shown in FIG. 3.
Figure 3B:
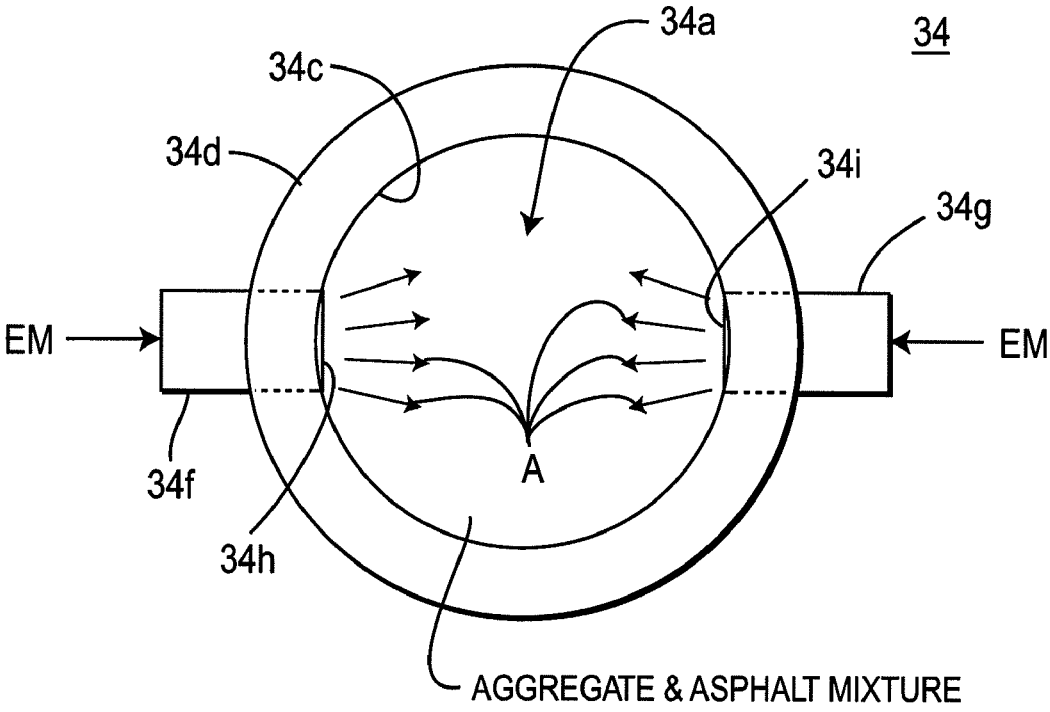
FIG. 3B is a sectional view of the mixing head looking in the direction of arrows 3B-3B in FIG. 3.

Coolant from the engine cooling system of the patcher 10, which is typically heated to a temperature in the range of 135-160 and preferably 150 degrees F., enters into a hot water inlet coupling 34*b* and circulates through the hollow interior of the mixing head defined by the inner and outer cylinder walls 34*c* and 34*d*, shown in FIG. 3B, leaving the mixing head by way of coupling outlet 34*e* which returns the cooling fluid through a suitable conduit to the engine radiator, not shown, and forming part of the engine cooling system employed for driving the vehicle which is also not shown for purposes of simplicity.

The emulsion storage tank 20 is coupled to an inlet port 102*a* of a multi-port valve 102 having a common outlet port 102*b* which is selectively coupled to one of the ports respectively arranged at 3 o'clock, 6 o'clock, 9 o'clock and 12 o'clock positions about the sidewalls of valve 102. Valve 102 is preferably enclosed within an insulating jacket 104 having inlet and outlet ports 104*a* and 104*b* for respectively introducing hot water from the engine cooling system into jacket 104 and for returning the hot water to the engine cooling system. The hot water flowing through jacket 104 maintains asphalt emulsion passing through valve 102 in a heated, flowable condition to prevent clogging of the valve 102.

When valve 102 is moved to the position coupling 12 o'clock port 102*a* to common port 102*b*, heated asphalt from tank 20 passes through valve 102 and enters asphalt line 106, which is one of the lines that is enclosed within the hollow, insulated non-collapsible hose 44, shown in FIG. 2B.

A valve assembly, preferably a one-half inch (0.50") ball valve assembly 108, is connected in line 106 and is operated under the control of a custom linear actuator 109 operated under control of an actuator switch 111 located in the patcher cab 14 to provide an adjustable flow rate of the asphalt emulsion through line 106. Line 106 is split by a T-coupler 110, providing a first branch 112*a* which is coupled to the common port 114*a* of control valve 114 and a second branch 112*b* coupled to common port 116*a* of control valve 116.

Multi-position control valves 114 and 116, as well as valve 102, are substantially identical in design and function, as will be more fully described in connection with FIG. 3A. Valves 102, 114 and 116 are each respectively enclosed within a heating jacket 104, 115, 117 each of which are electrically heated to maintain the asphalt emulsion in heated, flowable state and thereby prevent freezing of asphalt in these valve structures when patcher 10 is shut down and stored overnight or during weekends, in cold temperature regions, by coupling the electrically operable heating jackets to a suitable power source (not shown).

FIG. 3A is a perspective view of one of the four-position control valves, such as valve 116, it being understood that both control valves 114 and 116 (as well as valve 102) are substantially identical in design and function, and it being further understood that the positions of the outlet ports of valves 114 and 116 in FIG. 3 are symmetrical about an axis of symmetry which is coaxial with a central axis of mixing head 34. Only one control valve will be described in detail for purposes of simplicity.

The control valve 116 shown in FIG. 3A is a substantially solid block provided with ports 116*b*, 116*d*, 116*c* and 116*e*, respectively arranged at 12 o'clock, 3 o'clock, 6 o'clock and 9 o'clock positions around the top, right-hand, bottom, and left-hand side surfaces of the control valve. An operating handle 116*f* is mounted along the front face of the control valve and may be selectively positioned in one of the 12, 3, 6 and 9 o'clock positions. The control valve 116 is provided with a common inlet opening 116*a* (not shown in FIG. 3A) along its rear surface. By positioning the control valve operating handle so that its tapered shape tip 116*f*-1 is aligned with one of the four (4) given positions 116*b*-116*e*, that port communicates with common port 116*a* in accordance with the alignment of the rotatable operating handle 116*f*.

The valve assembly 116 comprises a hollow housing and is further provided with a pair of openings 116*g* and 116*h* along respective diagonal side surfaces for receiving coolant from the patcher engine cooling system to heat the valve and thereby maintain asphalt passing through the control valve 116 during a patching operation, to be in a heated, flowable state and thereby prevent the control valve 116 (as well as control valves 114 and 102) from becoming clogged with cooled emulsion.

An air supply line 118 derives air under pressure directly from the air brake supply of the patcher air brake system (i.e., without any reduction in pressure), not shown for purposes of simplicity. Air pressure of the order of 120 psi is supplied to the air line 118. A T-coupler 120 feeds the pressurized air to branch lines 122*a* and 122*b*, each of which are respectively coupled to the 12 o'clock inlet ports 114*b* and 116*b* of multi-position valves 114 and 116.

The 6 o'clock ports 114*c* and 116*c* of multi-position valves 114 and 116 are respectively coupled through one-way valves 122 and 124 to one of the inlets 34*f* and 34*g* which extend through outer and inner jacket walls 34*c* and 34*d* of mixing head 34 (see FIG. 3B) in order to introduce asphalt emulsion at diametrically opposed openings provided along the inner and outer jackets 34*c* and 34*d* and thereby introduce asphalt emulsion into the hollow interior of the mixing head 34. Suitable dispersing members 34*h* and 34*i*, shown in FIG. 3B, are substantially flush with the interior jacket 34*c*, to disperse the asphalt emulsion throughout the hollow interior of the mixing head, as shown by arrows A, to coat the aggregate fed into mixing head 34.

As was previously mentioned, the aggregate passes through curved member 40 and into the hollow interior of mixing head 34 where the aggregate is admixed with and coated by the liquid emulsion and then passed through the outlet end, i.e., nozzle, 34*j* of the mixing head 34 for deposit into a pothole or other crevice or recess being coated and/or repaired. As was mentioned above, air under pressure may be introduced into mixing head 34 while the emulsion feed lines and aggregate line are closed, to clean debris from a pothole. Also, air under pressure enters the flexible hose 35 and telescoping assembly 36 to advance the aggregate into the mixing head 34.

Check valves 122 and 124 are preferably respectively coupled between outlet ports 114*c* and 116*c* and couplings 34*f* and 34*g*, allowing emulsion to pass in only one direction and enter into the mixing chamber of mixing head 34 while preventing any reverse flow of the asphalt emulsion from the mixing head back into the control valves 114 and 116 through ports 114*c*, 116*c*.

The one-way check valves 122 and 124 are preferably provided with jackets having inlet and outlet ports similar to the ports 116*g* and 116*h* of valve 116, as shown in FIG. 3A, to receive coolant to heat the check valves during patching operations. For simplicity, check valves 122 and 124 are shown as being enclosed within the heating jackets 115 and 117, but may be provided with their own heating jackets, which maintain any asphalt emulsion within the jackets in the heated, flowable state regardless of the ambient temperature and thereby prevent the one-way valves from becoming clogged with cooled emulsion. Check valves 115 and 117 have a housing provided with inlet and outlet openings similar to the openings 116*g*, 116*h* provided in housing 116 shown in FIG. 3A, to receive coolant to heat the check valves and hence the emulsion flowing therethrough in the same manner as valve 116. Heating jackets 115, 117 may also electrically heat one-way valves 122 and 124 when not in use.

Control valves 114 and 116 are further provided with outlet ports 114*d* and 116*d*. Back flush conduits 126 and 128 are coupled between ports 114*d*, 116*d* and recovery tank 130. Flush tank 132 contains cleaning agent pressurized by air pressure source 118, to flush the feed lines 106, 112*a* and 112*b*. Recovery tank 130 is located above flush tank 132 to provide for the flow of cleaning agent by gravity from recovery tank 130 to flush tank 132, when normally-closed valve 134 is open and flush tank 132 is de-pressurized. Any suitable cleaning agent having cleansing and/or flushing capabilities may be used. In the preferred embodiment pine oil extract is employed as the cleaning agent in order to accumulate the emulsion for use with emulsion delivered from the heated storage tank 20, as will be more fully described.

Patcher 10 operation is initialized by assuring that air pressure provided to the asphalt storage tank 20 and the flush tank 132 are within the range of 50-70 psi and that the air brake system is developing air pressure in the range of 100-120 psi. Valve 136, coupled near the outlet of the air brake pressure source, is a regulator valve which, when open, regulates the output pressure introduced into the flush tank 132 and the asphalt storage tank 18, through port 102*c* in valve 102, to obtain the desired pressure levels mentioned above. Valves 114 and 116 have their operating arms placed in the 12 o'clock position, causing air entering lines 122*a* and 122*b* to enter ports 114*b*, 116*b*, pass through valves 114 and 116 and enter into the feed lines 112*a* and 112*b*. The air brake pressure source fed to the line 118 bypasses the valve 136 and thus provides maximum pressure (i.e., 100-120 psi) to the 12 o'clock ports 114*b*, 116*b* of valves 114 and 116 to clear lines 112*a*, 112*b* and 106. Valve 102 is then placed in the 12 o'clock position. The actuator switch 111 in the patcher cab 14 (see FIG. 3) is operated to activate linear actuator 110 and open ball valve 108. Air blows through the valves 102, 114, 116, and feed lines 112*a*, 112*b* and 106, clearing valves 102, 114 and 116 and feed lines 106, 112*a* and 112*b* of emulsion and returning the emulsion to tank 20. The air pressure in the feed lines drops after 1-2 minutes. The pressure is monitored by a pressure gauge (not shown) in cab 14. The ball valve 108 is then closed by operating switch 111. Thereafter, the operating arms of both valves 114, 116 are moved to the 6 o'clock position in readiness for a patching operation. Emulsion may take approximately 30 seconds to flow to mixing head 34 since air may still be in the feed lines.

During a typical patching operation, a pothole in the roadway surface is cleaned by blowing high-volume air into the pothole. Air under pressure is introduced into feed line 106 from port 102*c* and common port 102*b* by placing the operating arm of valve 102 in the 3 o'clock position and placing the operating arms of valves 114 and 116 in the 6 o'clock position, enabling air under pressure to exit through outlet 34*j* of mixing head 34. Air under pressure is emitted from outlet 34*j* to clear debris from a pothole.

In a second step, a tack coat of emulsion may be applied to the area to be treated by coupling the storage tank 20 to inputs 34*f*, 34*g* of the mixing head through valves 102, 114 and 116.

In a third step, a mixture of aggregate admixed with heated emulsion is emitted from the mixing head 34 to fill the pothole. The valve 102 is placed in the 12 o'clock position and valves 114 and 116 are placed in the 6 o'clock position to cause emulsion to flow (under pressure) from the supply tank 20 to mixing head 34 through valve 102, lines 106, 112*a*, 112*b*, valves 114, 116 and one-way valves 122-124. A finished coat of a dry material may then be applied. The 3 o'clock port 102*c* of valve 102 can also receive air to blow out the feed line 106, if desired. It has been found that sprayed injection patching is the most economical and longest lasting method for pothole repair.

In order to clean the internal lines of asphalt emulsion, while at the same time preventing discharge of cleaning agent from the system and completely recycling the asphalt and cleaning agent, control valves 102, 114 and 116 are operated in the following manner:

A shut-down storage operation is initiated by introducing air into the feed lines by operating switch 111, located in cabin 14, to fully close the ball valve 108. The operating handles of control valves 102, 114 and 116 are respectively moved to the 3 o'clock, 12 o'clock and 12 o'clock positions. Ball valve 108 is then opened and maintained open for approximately 1 to 2 minutes until the air pressure in the feed lines drops (monitored by the aforementioned air gauge in cab 14) whereupon the ball valve 108 is then fully closed.

Valves 114 and 116 have their control arms respectively moved to the 9 o'clock and 3 o'clock positions. Control valve 102 is then moved to 6 o'clock position 102*d*, coupling flush tank 132 to feed line 106 through ports 102*d*, 102*b* of valve 102 in readiness to perform a flushing operation.

Actuator 109 is operated to open ball valve 108, enabling solvent in pressurized flush tank 132 to enter the 6 o'clock port of valve 102 and pass through valve 102, feed lines 106, 112*a* and 112*b* and valves 114 and 116 and then to recovery tank 130 through back flush lines 126 and 128. One of these lines, such as line 128, is preferably formed of a clear transparent material, enabling an operator to view the cleaning agent as it moves from flush tank 132, through valve 102, feed lines 106, 112*a*, 112*b*, valves 114 and 116 and back flush lines 126, 128 and enter into recovery tank 130, shown in FIGS. 1C, 3, 3C and 3D. The asphalt is removed from lines 106, 112*a*, 112*b* and valves 114, 116 by the cleaning agent as can be viewed passing through the clear line 128. The ball valve 108 is then returned to the closed position.

Figure 3C:
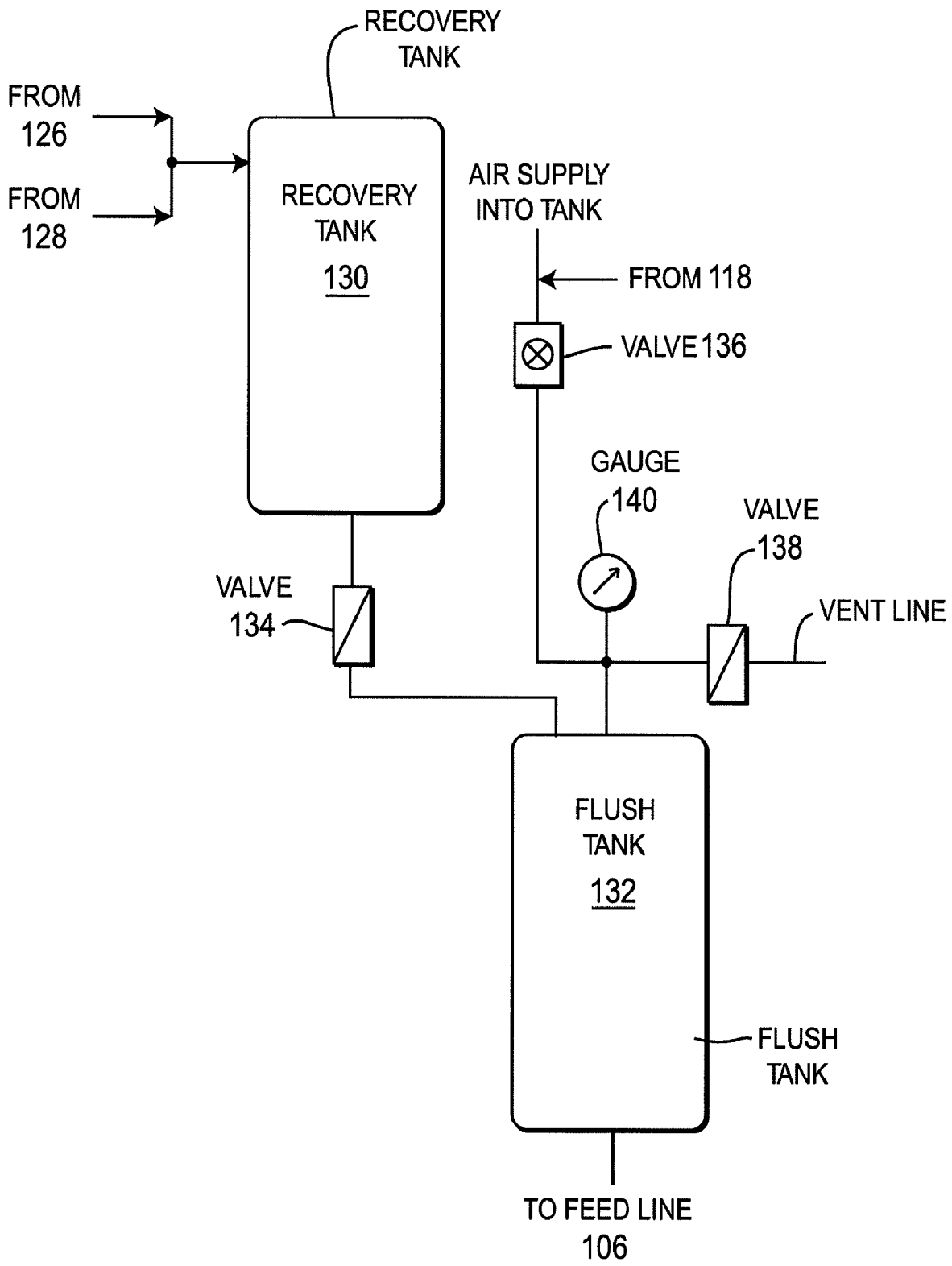
FIGS. 3C and 3D are perspective and simplified schematic views of the flush and recovery tanks shown in FIG. 3.
Figure 3D:
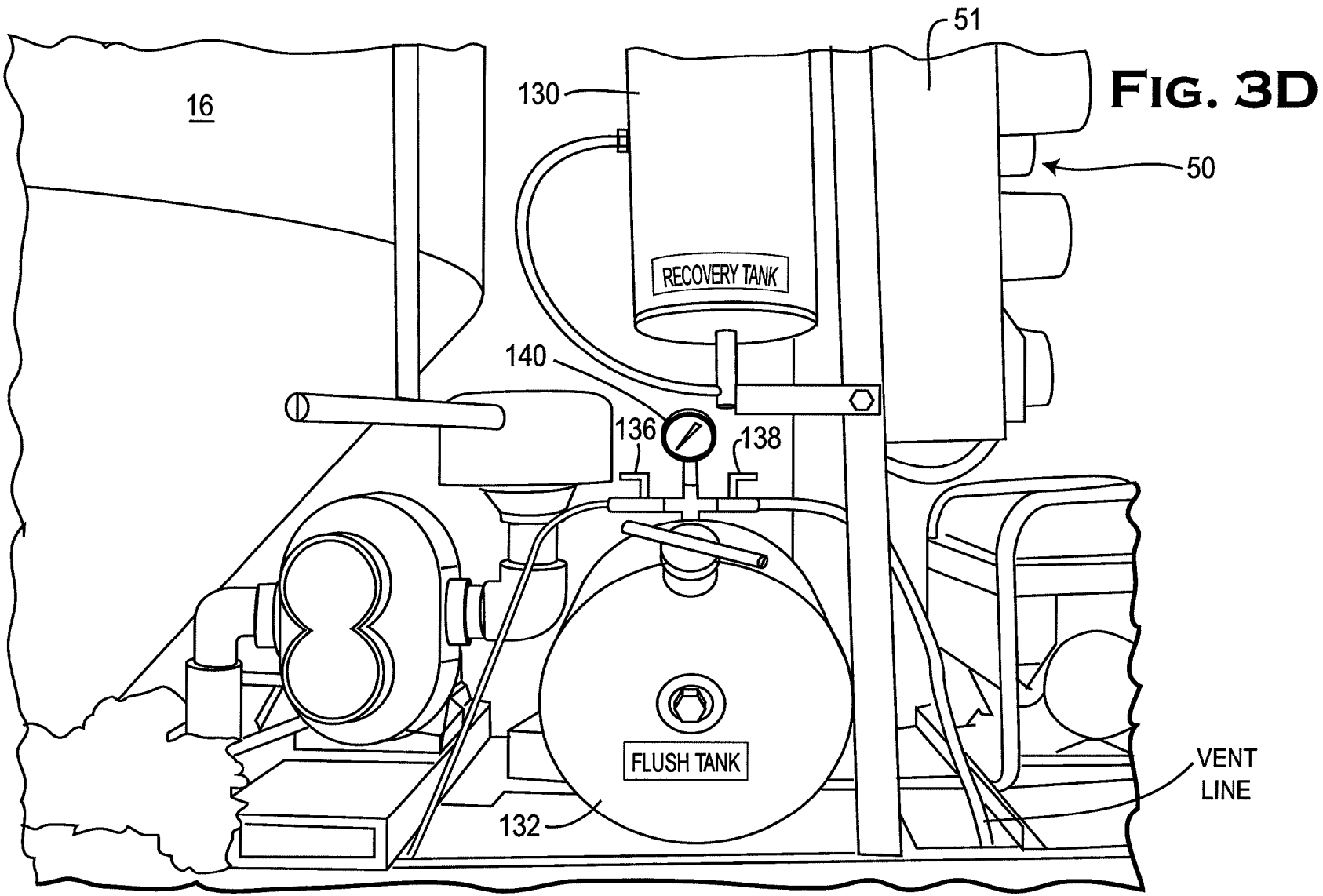

The cleaning agent is returned to flush tank 132 from recovery tank 130 by respectively moving the operating arms of valves 114 and 116 to the 3 o'clock and 9 o'clock positions and closing valve 102 (by moving the operating arm of valve 102 to the 9 o'clock, i.e., "plug" position 102*e*). The air supply line to flush tank 132 and to the emulsion tank 20 is closed by closing valve 136. The air under pressure in flush tank 132 is vented to the atmosphere by opening valve 138 as shown in FIG. 3C. When the reading of pressure gauge 140 reads "O" (zero) psi, flush tank 132 is now relieved of air pressure.

Closed valve 134 is then opened for 2-3 minutes to drain the recycled cleaning agent, delivered by gravity to recovery tank 130 by lines 126 and 128, back into flush tank 132 and valve 134 is then closed.

The air pressure release valve 138 which bleeds air from tank 132 to the atmosphere is closed and valve 136 is opened to repressurize tank 132 and emulsion supply tank 20 from pressure source 118, completing the back flush operation and retaining all of the solvent and emulsion in the closed system. The connections for the flush operation may be reversed by coupling the flush tank 132 to valves 114 and 116 and coupling the recovery tank 130 to valve 102, if desired.

Asphalt emulsion residing in feed lines 106, 112*a* and 112*b* is carried into the recovery tank 130 together with the cleaning agent which is preferably pine oil extract. The residue emulsion is accumulated as the patching operations are performed. It is preferred that the concentration of asphalt emulsion reaches a level of the order of at least 90% and preferably at least 95%. The collected asphalt, admixed with the cleaning agent is utilized during a patching operation and is admixed with asphalt from storage tank 20, thus making highly efficient use of asphalt collected by the cleaning agent during a flushing operation, for subsequent reuse. A suitable instrument such as an in-line viscometer or a pressure differential indicator is utilized to provide an indication as to when the asphalt emulsion accumulated in the cleaning agent is adequate for use together with fresh asphalt emulsion during the patching operation. When the concentration of the asphalt emulsion is suspended in the cleaning agent is of a sufficient level, preferably of the order of 90%-95%, the cleaning agent admixed with the emulsion may be introduced into the dispensing head through port 102*d* of output 102, line 106 and lines 112*a*, 112*b* into the mixing head through ports 114*c*, 116*c* of valves 114 and 116. Thereafter, emulsion from storage tank 20 may be fed to the mixing head to be admixed with the recaptured asphalt emulsion. A fresh supply of the cleaning agent may be introduced into the recovery tank 130 or flush tank 132 by a suitable filler opening, not shown for purposes of simplicity.

Figure 4B:
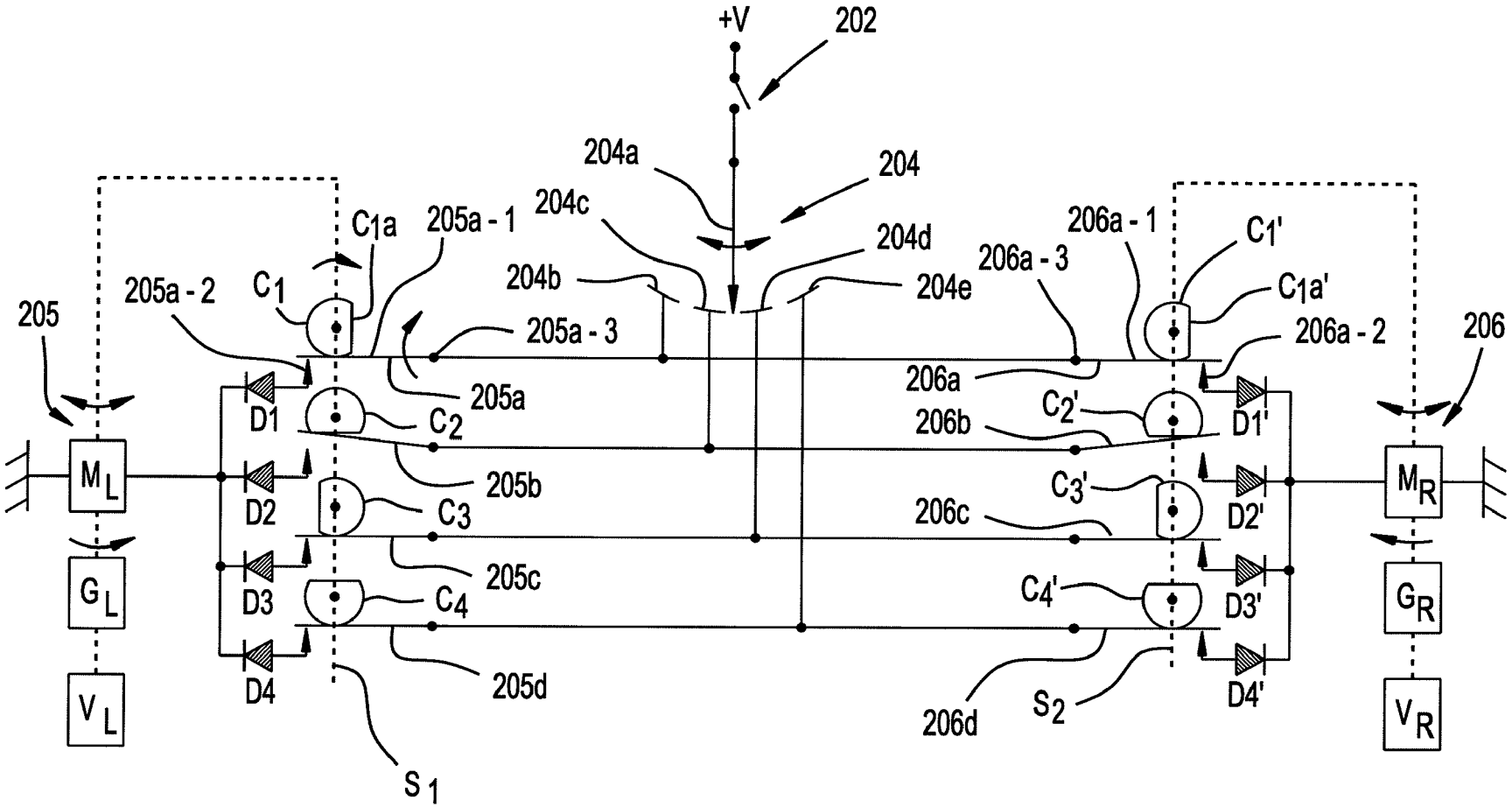
FIG. 4B is a schematic view showing the control circuitry for operating the motors driving the pair of multi-position control valves.
Figure 4C:
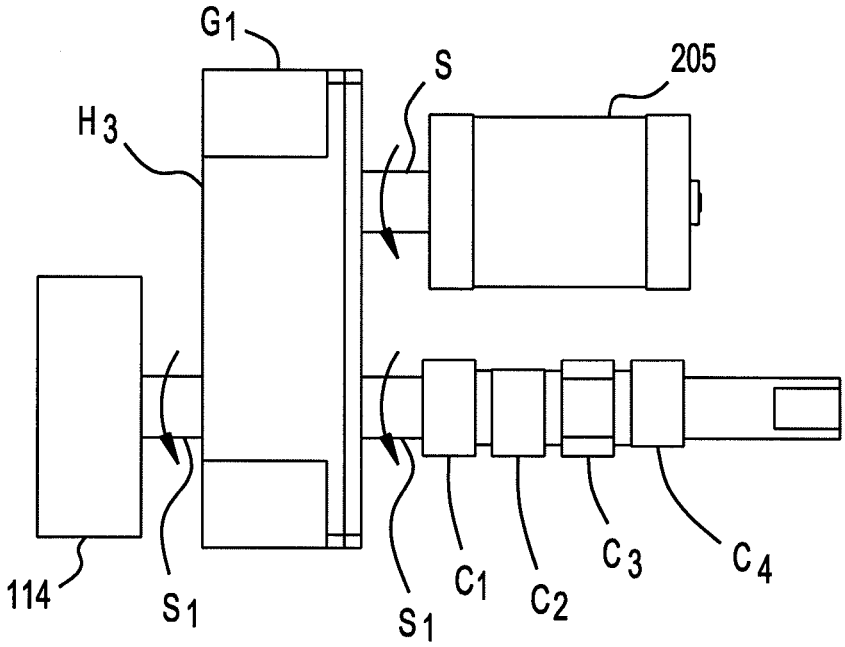
FIG. 4C is a simplified diagram showing the mechanical components utilized to drive one of the multi-position control valves.
Figure 4D:
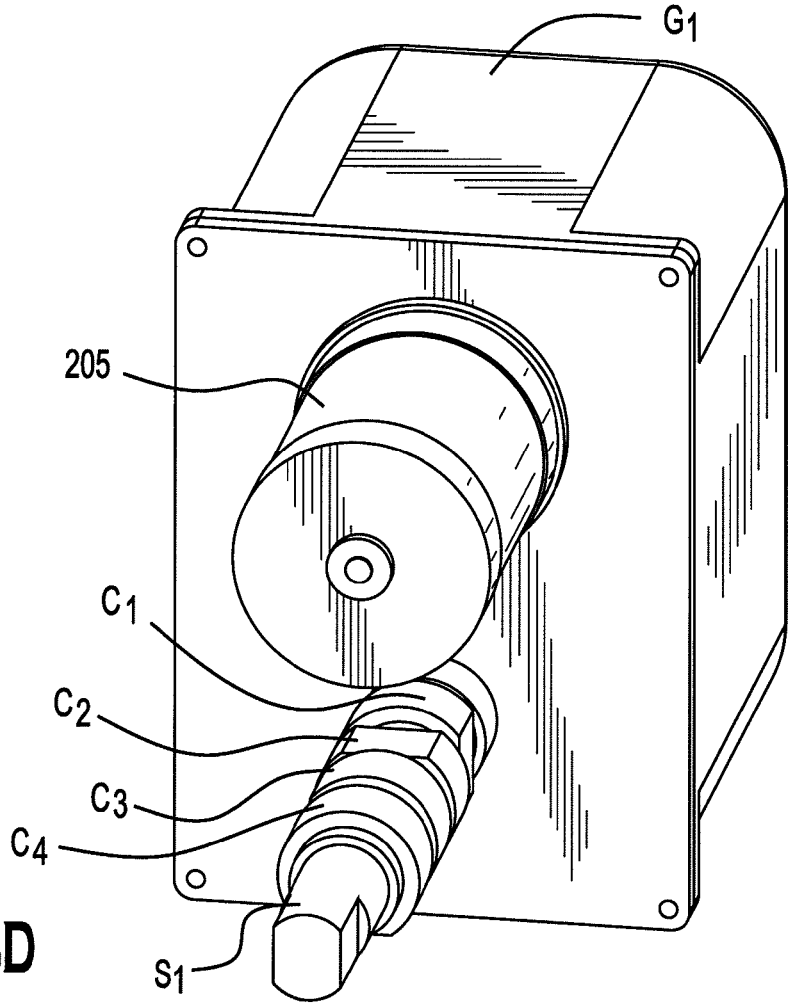
FIG. 4D shows a perspective view of one of the controls shown in FIG. 4 with the cover removed for purposes of observing the five motor, the gear box coupling the foot shaft of the drive motor to the control valve and the cam shaft driving the cams utilized to control the timing of the electrically switches.

Making reference to FIGS. 4 through 4D, operation of the multi-position valves 114 and 116 is electrically operated from the patcher cabin 14 which is provided with a control panel 200 shown in FIG. 4A and provided with an On/Off switch 202 and a control valve multi-position selection switch 204 for selecting one of the four ports of the two valves 114, 116 to be connected with the common port 114*a*, 116*a* of the control valves. FIG. 4B shows switches 202 and 204 in electrically schematic form, switch 202 electrically connecting or disconnecting the voltage source V+ in series with switch arm 204*a* of multi-position switch 204. Rotatable switch arm 204*a* is selectively movable to engage one of the four stationary contacts 204*b*-204*e*. Each contact 204*b*-204*e* is coupled in common to a pair of cam-operated contact switches 205*a*-205*b*, 206*a*-206*d*. For example, stationary contact 204*b* is coupled in common to a pair of cam-operated switches 205*a*, 206*a* for respectively controlling the operation of motors 205 and 206. Switch 205*a* is comprised of a movable switch arm 205*a*-1 and a stationary contact 205*a*-2 is selectively electrically connected to motor 205 through a diode D1. Movable switch arm 205*a*-1 is pivotally mounted at 205*a*-3 and is normally biased to move in the clockwise direction and thus be biased toward being disconnected from stationary contact 205*a*-1. Switch 206*a* has a movable contact 206*a*-1 and a stationary contact 206*a*-2 coupled to motor 206 through diode Dr. Movable contact 206*a*-1 is biased to move in the counterclockwise direction about pivot 206*a*-3. Each of the remaining switches 205*b*-205*d* for motor 205 and switches 206*b*-206*d* for motor 206 have a similar structure.

The output shaft of each motor 205 and 206 is respectively coupled to its multi-position valve through a gear box G1 and G2. The output of each gear box G1 and G2, in addition rotating the operating arm of its associated control valve to couple one of the ports of its associated multi-position valve to the common port, further rotates a common shaft S1 driven by gear box G1 for simultaneously rotating four cams C1-C4 arranged along shaft S1 and four cams C1-C4' arranged along shaft S2. Each of the cams C1-C4 and C1'-C4' has a "flat." Note, for example, cams C1 and C1' having flats C1*a* and C1*a*'. Assuming switch 202 is closed and switch arm 204*a* of switch 204 is in contact with stationary contact 204*b*, power is provided from source V+ through closed switches 202, 204*a*-204*b* and switch arms 205*a*-1, 206*a*-1 and diodes D1, D1' to motors M1 and M2, switches 205*a*-1 and 206*a*-1 being closed at the present time due to the fact that switch arms 205*a*-1 and 206*a*-1 engage the curved surfaces of cams C1 and C1', which urge 205*a*-1-205*a*-2 and 206*a*-1-206*a*-2 to the closed position. The motors M1, M2 being energized, rotate their respective output shafts, which are coupled through gear boxes G1 and G2 to drive the operating arms of the multi-position valves 114, 116 and the shafts S1 and S2, respectively. As the shafts S1 and S2 rotate, the cams C1 and C1' move to a position having their "flats" C1*a* and C1*a*' aligned with their associated switch arms 205*a*-1 and 206*a*-1, enabling movable switch arms 205*a*-1 and 206*a*-1 to move away from their associated stationary contacts 205*a*-2, 206*a*-2, and power is disconnected from motors 205, 206.

When switches 205*a*, 206*a* are closed, power is delivered through diodes D1, D1' to motors 205, 206 but is prevented from being fed through any of the switches 205*b*-205*d* which, although one or more of the other switches may be closed, they are prevented from receiving power from diodes D1, D1' due to the polarities of diodes D2-D4, D2'-D4'. The diode arrays D1-D4, D1'-D4' also prevent any feedback of power to all other closed switches in the event, for example, that switch 205*a* were to open before switch 206*a* (or vice versa), due to the reverse polarities of diodes D2' through D4', for example, thereby enabling motor 206 to be energized until the "flat" C1*a* of cam C1 is moved to a position aligned with switch arm 206*a*-1, enabling switch arm 206*a*-1 to open. All of the remaining cams C2-C4 and C2'-C4' operate in a similar fashion, thus enabling a single power line and one switch to simultaneously provide power to motors 205 and 206 utilizing only a single On/Off switch 202 and multi-position switch 204 to operate the motors 205, 206 and provide accurate alignment of the valves 114, 116, even in the event that motors 205, 206 have electrical characteristics which differ from one another.

FIGS. 4C and 4D shown one typical electric motor 205 and associated mechanical drive G1 for operating the multi-position valve 114 and the cams C1-C4. The housing of motor 205 is directly mounted to one surface of a housing H3 containing gear box G1. The output shaft S serves as a mechanical input drive to gear box G1 which is provided with a gear assembly to rotate the output shaft $S_1$ of gear box G1 at a desired angular speed. Shaft S1 also drives multi-position valve 114. Shaft S1 extends to the left and into the multi-position valve 114. Shaft S1 further extends to the right to receive the cams C1-C4. FIG. 4 shows the motor drives 205 and 206 enclosed within housing covers H1 and H2, respectively, while FIGS. 4C and 4D show motor drive 205, shafts S and S1 and cams C1-C4 with the housing cover H1 removed. Each of the motor drives is provided with a manually operable control arm 206, 208 providing a manual override in case of loss of electrical power.

The cam arrays C1-C4 and C1'-C4' may be adjusted so that their angular orientation on the shaft upon which they are mounted assures that the selected port associated with each cam pair is properly aligned.

What is claimed is:

1. A method for collecting for reuse an emulsion for patching potholes and the like, comprising:

a) providing a cleaning agent compatible for admixing with the emulsion in a flush tank for subsequent patching use;

b) pressurizing the cleaning agent in the flush tank;

c) providing the emulsion in a storage tank;

d) pressurizing the emulsion in the storage tank;

e) providing a feed line;

f) providing first and second multi-position valves along the feed line and between the storage tank and a dispensing device for selectively controlling a flow of emulsion and cleaning agent;

g) closing an output of the flush tank and feeding emulsion from the storage tank through the first valve and the feed line by operating the first valve to a first position and operating the second valve to a first position for coupling the feed line through the second valve to the dispensing device;

h) disconnecting the storage tank from the feed line and connecting the flush tank through the first valve to the feed line to feed cleaning agent through the first valve and the feed line by moving the first valve to a second position;

i) feeding cleaning agent through the second valve and a return line to a recovery tank by moving the second valve to a second position, whereby the pressurized cleaning agent removes emulsion from the first and second valves, the feed line and the return line whereby the admixed cleaning agent and removed emulsion is collected in the recovery tank; and j) coupling the recovery tank to the flush tank by de-pressurizing the flush tank and coupling the recovery tank to the flush tank by opening a closed third valve to transfer the contents of the recovery tank to the flush tank for a subsequent cleaning operation, whereby the admixed cleaning agent and removed emulsion are accumulated in the flush tank for subsequent use to repair potholes by feeding the admixed cleaning agent and removed emulsion accumulated in the flush tank to the dispensing device for repairing a pothole, and k) coupling the flush tank to the dispensing head through the first and second valves by moving the first valve to the second position and the second valve to the first position when the collected emulsion reaches a given concentration.

2. The method of claim 1, comprising:

repeating steps (g) through (j) to perform subsequent pothole repair operations performed by the patching apparatus.

3. The method of claim 2 wherein use of collected emulsion for repairing potholes is enabled after a given time period which is in the range of 2 to 5 weeks measured from a time that fresh compatible cleaning agent is initially introduced into the flush tank.

4. The method of claim 1 wherein the cleaning agent is selected so that the emulsion dissolves in the cleaning agent.

5. The method of claim 1 comprising providing the feed line with a transparent portion to visually observe the flow of cleaning agent and emulsion to determine when the feed line has been adequately flushed.

6. The method of claim 1 comprising providing the feed line with a transparent portion to permit visual external observation of the emulsion and cleaning agent flowing through the feed line to determine that the collected emulsion is sufficient for use in a pothole repair operation by observing a depth of color of fluid flowing through the transparent portion.

7. The method of claim 1 comprising determining an amount of emulsion collected in the cleaning agent by using one of a viscometer and a pressure differential indicator.

8. The method of claim 1 wherein the compatible cleaning agent is pine oil extract.

9. The method of claim 1 wherein the emulsion is an asphalt emulsion.

* * * * *

UNITED STATES PATENT AND TRADEMARK OFFICE

CERTIFICATE OF CORRECTION

PATENT NO. : 8,376,654 B2
APPLICATION NO. : 12/871466
DATED : February 19, 2013
INVENTOR(S) : Scott P. Kleiger It is certified that error appears in the above-identified patent and that said Letters Patent is hereby corrected as shown below:

IN THE SPECIFICATION

In Column 4, Line 19, delete “is” and insert -- is a --, therefor.

In Column 10, Line 30, delete “Dr.” and insert -- D1'. --, therefor.

In Column 10, Line 41, delete “C1-C4'” and insert -- C1'-C4' --, therefor.

Signed and Sealed this
Eleventh Day of June, 2013

Teresa Stanek Rea
*Acting Director of the United States Patent and Trademark Office*